US005599189A

United States Patent [19]

Kees

[11] Patent Number: 5,599,189

[45] Date of Patent: Feb. 4, 1997

[54] REUSABLE LEARNING AID

[76] Inventor: Max O. Kees, 915 S. 49th St., Temple, Tex. 76054

[21] Appl. No.: 525,296

[22] Filed: Sep. 7, 1995

[51] Int. Cl.[6] ..... B43L 1/12

[52] U.S. Cl. ..... 434/370; 434/408; 434/423

[58] Field of Search ..... 434/408, 370, 434/406, 422, 423, 365

[56] References Cited

U.S. PATENT DOCUMENTS

| | | | |
|---|---|---|---|
| 177,539 | 5/1876 | Montgomery | 434/422 |
| 1,757,287 | 5/1930 | Bildstein . | |
| 2,319,519 | 5/1943 | Rosaire | 434/405 |
| 2,586,017 | 2/1952 | Fredman | 434/304 |
| 2,608,771 | 9/1952 | Sparks . | |
| 2,791,040 | 5/1957 | Santorelli | 434/416 |
| 3,092,400 | 6/1963 | Smith . | |
| 3,206,225 | 9/1965 | Oleson . | |
| 3,236,977 | 2/1966 | Tusson | 434/405 |
| 3,252,462 | 5/1966 | Quarton . | |
| 3,553,864 | 1/1971 | Barlyn . | |
| 3,642,191 | 2/1972 | Roof | 434/408 |
| 3,838,520 | 10/1974 | Quenot . | |
| 4,427,391 | 1/1984 | Berman | 434/408 |
| 4,741,119 | 5/1988 | Baryla . | |
| 4,968,258 | 11/1990 | Kees | 434/378 |
| 5,110,295 | 5/1992 | Concra | 434/370 |
| 5,176,522 | 1/1993 | Robertson, Jr. | 434/408 |

FOREIGN PATENT DOCUMENTS

| | | | |
|---|---|---|---|
| 675453 | 5/1939 | Germany | 434/408 |
| 112374 | 1/1918 | United Kingdom . | |
| 464303 | 4/1937 | United Kingdom . | |
| 2255532 | 11/1992 | United Kingdom | 434/408 |

*Primary Examiner*—Paul J. Hirsch

*Attorney, Agent, or Firm*—Cynthia G. Seal; Buskop Law Group

[57] ABSTRACT

A learning aid permitting the student to insert a worksheet into a rigid body having space between two planes. One of the planes is clear permitting the instructor to mark on it, performing the work required by the underlying worksheet. The instructor's marking is erased and the student attempts the same task. The work sheet is secured in place by a clipboard. The clipboard rides in a slot to prevent scratching of the clear panel member. The clipboard may be secured in the slot by a latch mechanism.

12 Claims, 3 Drawing Sheets

REUSABLE LEARNING AID

BACKGROUND OF THE INVENTION

This invention relates to teaching and more particularly to aids for teaching.

Learning, especially at the lower grade levels, is through the repetitive performance of a task such as spelling, mathematics, geography, etc. The student is taught how the task is performed by observing the instructor perform the same or similar task and thereafter attempting the task themselves. Traditionally, this teaching is accomplished via a blackboard or other such display on a wall. The instructor prints a problem and explains the steps of the solution. The students are supplied with paper worksheets that have similar problems.

Although the paper worksheets are inexpensive to print, for young students many mistakes are made before the task is correctly performed. These mistakes must be erased; on paper this causes rips, tears, and smudges which inhibits the student in the learning process.

The modern classroom recognizes that students are individuals and perform their tasks and learn new ones at varying speeds. In the modern classroom, many subjects permit the student to "self-pace" or learn the subject at a speed with which the student feels comfortable. This improved approach to teaching means that the instructor is faced with the situation that multiple lessons are being performed simultaneously within the class. Explaining a particular task on the blackboard is not only cumbersome but is disruptive. Students who are either behind the task being performed or ahead of it find the black-board work confusing and interruptive.

Recognizing that it is desirable to be able to use the worksheet itself as a visual reference, several devices have been made permitting the worksheet to be secured under a clear plate. By writing on the clear plate, the worksheet can be repeatedly completed without actually marking on the worksheet. One type of device, uses hinges and heavy materials to secure the worksheet squeezed between two plates. The plates, when opened and shut, are disruptive in the classroom and are difficult for small children to utilize. In another type of device, as described in the inventors U.S. Patent, the sheet is positioned on a clipboard and then is inserted between the two plates. This arrangement may damage the transparent surface of the holder by scratching it thus making more difficult to see the underlying worksheet. This construction also does not provide a means to ensure that the clipboard stays in place. The clipboard may slide out, causing damage or injury. A device that would securely hold the clipboard away from the transparent surface would be highly desirable.

Other devices use flexible sheets of clear plastic. However, the flexible plastic is not conducive to repeated writing and erasure and eventually the ink from the underlying paper is transferred to the plastic. This creates smudges on the plastic, diminishing the transparency of the plastic.

OBJECTS OF THE INVENTION

It is an object of the present invention to provide a learning aid that is lightweight and easy to use.

It is a further object of this invention to provide a learning aid that can be used with a clipboard without damaging the transparent surface of the learning aid.

It is yet another object of this invention to provide a learning aid that has a latching means to hold the clipboard in the frame of the learning aid.

SUMMARY OF THE INVENTION

In one embodiment of the present invention, there is provided a learning aid having a first panel member and a second panel member, positioned parallel to one another in a spaced apart relationship by a frame. Both panels are rectangular in shape and substantially the same size. The frame extends around the periphery of the panels leaving one end open for the insertion of a third panel member. The third panel member is a rigid body having two sides. The paper is secured to the third panel member through the use of a clipping mechanism. The clipping mechanism as used in this context is any of those well known to those of ordinary skill in the art. The key is to permit the student to physically attach/deattach the worksheet to the third panel member.

The frame has a first leg, a second leg and a bottom leg. The frame also has a first side surface, a second side surface, a first end and a second end The frame is positioned around the periphery of three sides of the first panel member and second panel member leaving an open end. The frame secures the first layer substantially parallel to the second layer in spaced apart relationship, forming a compartment between the first side surface of the frame, the first plate member and the second plate member. The third panel member is sized for insertion into the compartment. The third panel member has a first side, a second side, a first edge, a second edge, and a means for securing a sheet of paper to the first side. The first edge is generally parallel to the second edge.

The first side surface of the first leg defines a first slot and the first side surface of the second leg defines a second slot. The first edge of the third panel member is closely received by the first slot and the second edge of the third panel member is closely received by the second slot. The first side of the third panel member is secured in a spaced apart relationship with the first panel member. The second side of the third panel member is also secured in a spaced apart relationship with the second panel member. This prevents the transparent panel from being scratched as well as both sides of the third panel member when the third panel member is fully inserted. Preferably, the frame has a latch means to prevent the third panel member from sliding out of the frame.

DETAILED DESCRIPTION OF THE PREFERRED EMBODIMENTS

Figure 1:
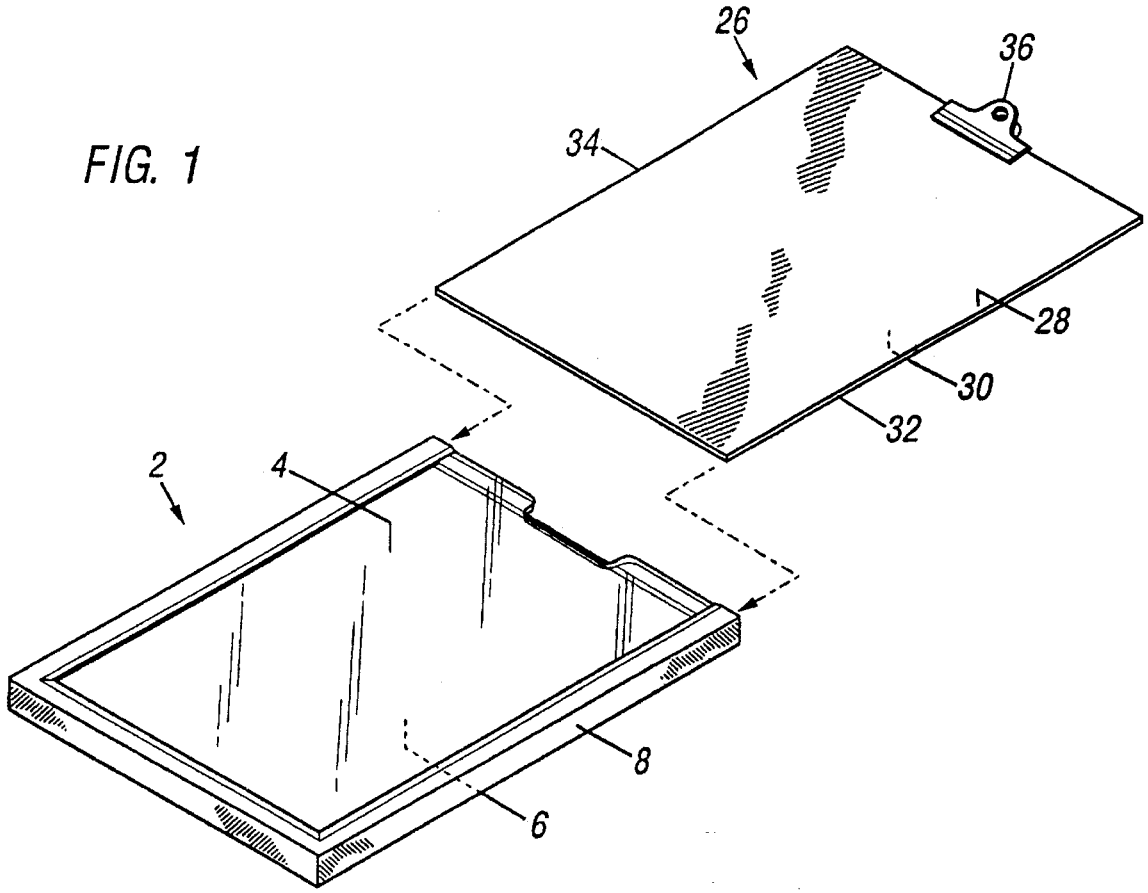
FIG. 1 is an exploded view of the invention utilizing the third panel member.
Figure 2:
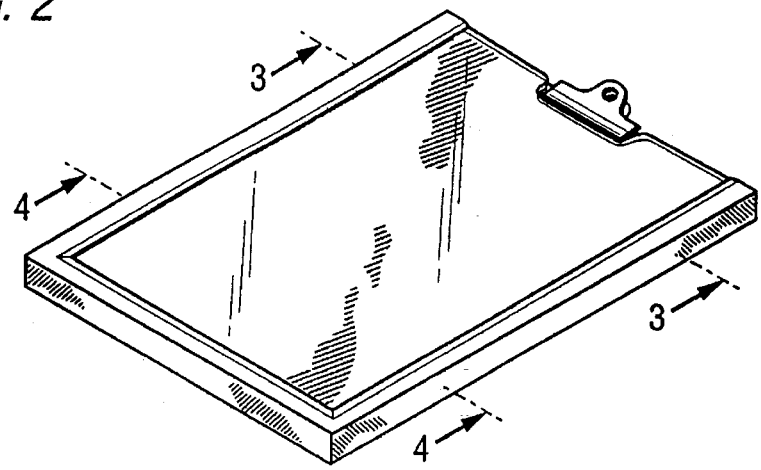
FIG. 2 is a pictorial view of the invention showing the third panel member inserted in the frame.
Figure 3:
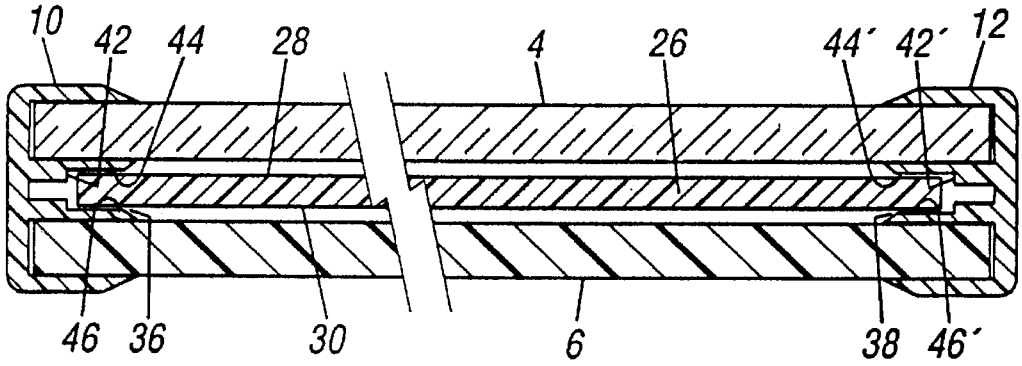
FIG. 3 is a cross sectional view of FIG. 2 along cut lines 3—3.
Figure 4:
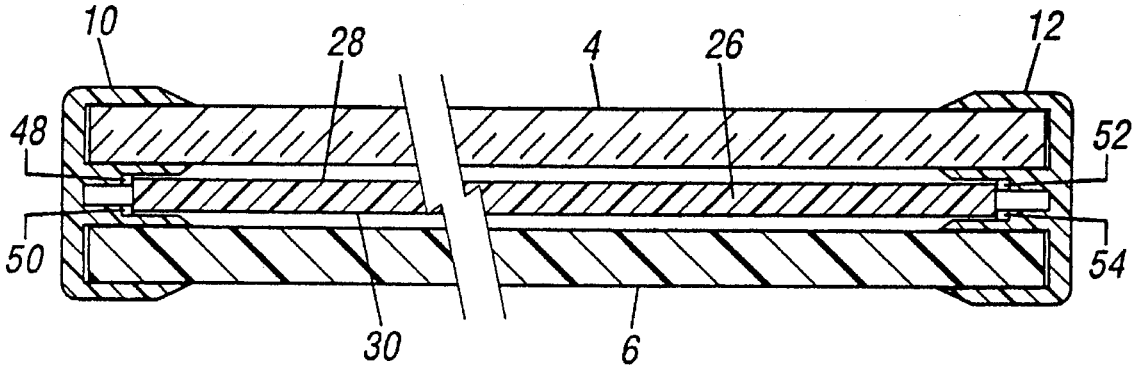
FIG. 4 is a cross sectional view of FIG. 2 along cut lines 4—4, showing the brake shoes.
Figure 5:
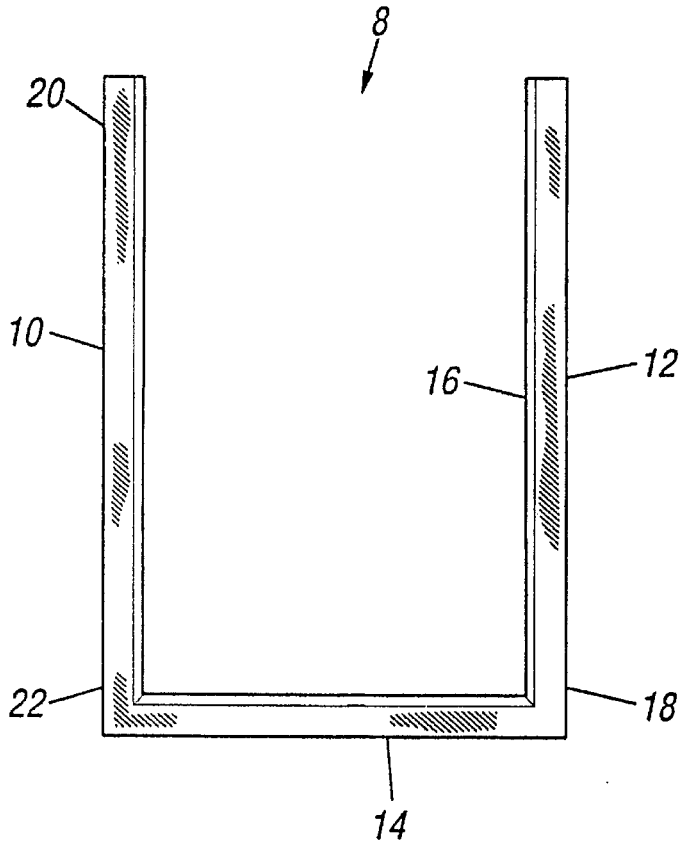
FIG. 5 is a plan view of the frame.
Figure 6:
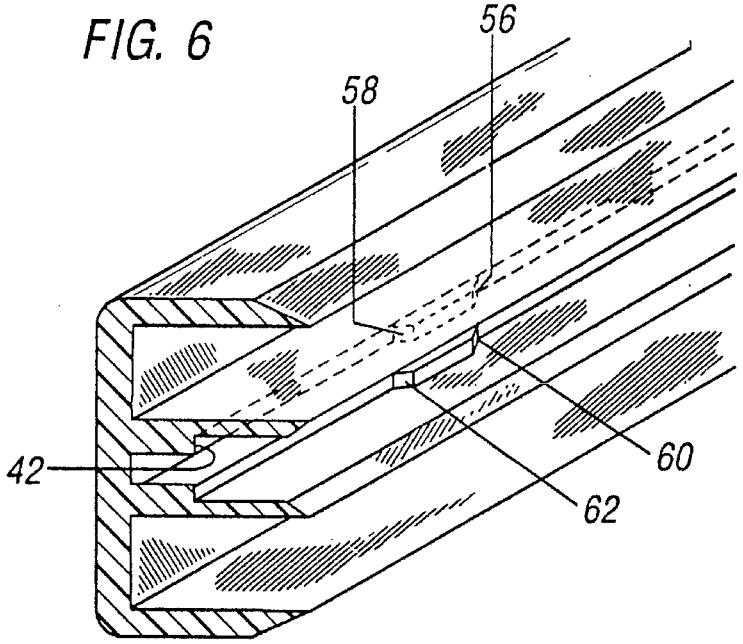
FIG. 6 is a pictorial view of a portion of the frame showing details of the brake shoes.

In one embodiment of the invention there is provided an improved learning aid 2 having a first panel member 4, a second panel member 6, a third panel member 26 and a frame 8. The first and second panel members are substantially rectangular in shape and each having four sides. The second panel member 6 is approximately the same size as the first panel member 4. The first panel member 4 is transparent. Preferably, the first panel member 4 is made of acrylic and the second panel member 6 is made of melamine or other structural product. The frame 8 has a first leg 10, a second leg 12 and a bottom leg 14. The frame 8 also has a first side surface 16, a second side surface 18, a first end 20 and a second end 22. The frame 8 is positioned around the periphery of three sides of the first panel member 4 and second panel member 6 leaving an open end 24. The frame 8 secures the first panel member 4 substantially parallel to the second panel member 6 in spaced apart relationship, forming a compartment defined between the first side surface 16 of the frame 8, the first panel member 4 and the second panel member 6. The third panel member 26 is sized for insertion into the compartment. The third panel member 26 has a first side 28, a second side 30, a first edge 32, a second edge 34, and a means for securing a sheet of paper to the first side 28. The first edge 32 is generally parallel to the second edge 34.

The first side surface 216 of the first leg 10 defines a first slot 36 and the first side surface 16 of the second leg 12 defines a second slot 38. The first edge 32 of the third panel member 26 is closely received by the first slot 36 and the second edge 34 of the third panel member 26 is closely received by the second slot 38. The first side 28 of the third panel member 26 is secured in a spaced apart relationship with the first panel member 4. The second side 30 of the third panel member 26 is also secured in a spaced apart relationship with the second panel member 6. Preferably, the frame 8 has a latch means to prevent the third panel member 26 from sliding out of the frame 8.

In a preferred embodiment, the first slot 36 is defined by a bottom surface 42, a first side surface 44 and a second side surface 46. The latch means preferably comprises a first brake shoe 48 protruding from the bottom surface 42 of the first slot 36 adjacent to the first side surface 44 and a second brake shoe 50 protruding from the bottom surface 42 adjacent to the second side surface 46. In use, the first brake shoe 48 and the second brake shoe 50 contact the first edge 32 of the third panel member 26 when the third panel member 26 is in an inserted position, to prevent the third panel member 26 from sliding out of the frame 8. The first brake shoe 48 and the second brake shoe 50 are preferably positioned near the second end 22 of the frame 8. Preferably, the second slot 38 is defined as the first slot 36 above, with a third brake shoe 52 protruding from the bottom surface 42' adjacent to the first side surface 44' and a fourth brake shoe 54 protruding from the bottom surface 42' adjacent to the second side surface 46', wherein the third brake shoe 52 and the fourth brake shoe 54 contact the second edge 34 of the third panel member 26 when the third panel member 26 is in an inserted position.

Preferably, the first brake shoe 48 has a first end 56 and a second end 58, and the first end 56 faces the open end 24 of the frame 8 and forms a beveled shoulder. The second brake shoe 50 also has a first end 60 and a second end 62, and the first end 60 faces the open end 24 of the frame 8 and forms a beveled shoulder. Preferably, the first brake shoe 48 and the second brake shoe 50 are positioned to contact the third panel member 26 when the third panel member 26 is fully inserted into the first slot 36 and second slot 38 of the frame 8. Preferably, the brake shoes are approximately 7/16 inches in length and approximately 0.025 inches in height.

In a preferred embodiment, the third panel member 26 comprises a clipboard having a top surface 28 and a bottom surface 30. The clipboard has a first edge 32 and a second edge 34, and the first edge 32 is generally parallel to the second edge 34. The first edge 32 is closely received by the first slot 36 formed by the first leg 10 and the second edge 34 is closely received by the second slot 38 formed by the second leg 12.

What is claimed:

1. An improved learning aid having:

(a) a first panel member having four sides, being substantially rectangular in shape;

(b) a second panel member having four sides, being substantially rectangular in shape and substantially the same size as said first panel member;

(c) a frame having a first leg, a second leg and a bottom leg, a first side surface and a second side surface, and a first end and a second end, said frame being positioned around the periphery of three sides of the first panel member and second panel member leaving an open end, wherein said frame secures said first panel member substantially parallel to said second panel member in spaced apart relationship, forming a compartment defined between the first side surface of the frame, the first panel member and the second panel member, (d) a third panel member sized for insertion into the compartment, said third panel member having a first side and a second side, a first edge and a second edge, wherein said first edge is generally parallel to said second edge, and a means for securing a sheet of paper to the first side of said third panel member;

wherein the improvement comprises:

an improved frame, wherein the first side surface of the first leg defines a first slot, and the first side surface of the second leg defines a second slot, wherein the first edge of the third panel member is closely received by the first slot and the second edge of the third panel member is closely received by the second slot, said first side of the third panel member is secured in a spaced apart relationship with the first panel member, and said second side of the third panel member is secured in a spaced apart relationship with the second panel member.

2. A learning aid as in claim 1, wherein the third panel member forms a clipboard having a top surface and a bottom surface and a first edge and a second edge, wherein said first edge is generally parallel to said second edge, said first edge being closely received by the first slot formed by the first leg and said second edge being closely received by the second slot formed by the second leg.

3. A learning aid as in claim 1, wherein the frame further comprises a latch means to prevent the third panel member from sliding out of the frame.

4. A learning aid as in claim 3, wherein the first slot is defined by a bottom surface, a first side surface and a second side surface, wherein said latching means comprises a first brake shoe protruding from the bottom surface of the first slot adjacent to the first side surface and a second brake shoe protruding from the bottom surface adjacent to the second side surface, wherein the first brake shoe and the second brake shoe contact the first edge of the third panel member when said third panel member is in an inserted position, to prevent said third panel member from sliding out of the frame.

5. A learning aid as in claim 4, wherein the second slot is defined by a bottom surface, a first side surface and a second side surface, wherein said latch means comprises a third brake shoe protruding from the bottom surface of the first slot adjacent to the first side surface and a fourth brake shoe protruding from the bottom surface adjacent to the second side surface, wherein the third brake shoe and the fourth brake shoe contact the second edge of the third panel member when said third panel member is in an inserted position, to prevent said third panel member from sliding out of the frame.

6. A learning aid as in claim 4 wherein the first brake shoe and the second brake shoe are positioned to contact the third panel member when the third panel member is fully inserted into the first slot and second slot of the frame.

7. A learning aid as in claim 6, wherein said first brake shoe and said second brake shoe are positioned near the second end of the frame.

8. A learning aid as in claim 6, wherein the first brake shoe further comprises a first end and a second end, wherein said first end faces the open end of the frame and forms a beveled shoulder.

9. A learning aid as in claim 5, wherein the second brake shoe further comprises a first end and a second end, wherein said first end faces the open end of the frame and forms a beveled shoulder.

10. A learning aid as in claim 4, wherein the brake shoes are approximately 7/16 inches in length and approximately 0.025 inches in height.

11. A learning aid as in claim 1, wherein said first panel member comprises acrylic.

12. A learning aid as in claim 1, wherein said second panel member comprises melamine.

* * * * *